United States Patent [19]

Ritter

[11] Patent Number: 4,700,418

[45] Date of Patent: Oct. 20, 1987

[54] STERILE MATTRESS UNIT

[76] Inventor: Russell F. Ritter, 132 Concord Dr., Buffalo, N.Y. 14215

[21] Appl. No.: 859,481

[22] Filed: May 5, 1986

Related U.S. Application Data

[63] Continuation-in-part of Ser. No. 735,846, May 21, 1985, Pat. No. 4,620,333.

[51] Int. Cl.[4] ..... A47C 27/08

[52] U.S. Cl. ..... 5/449; 5/90; 5/453; 5/463; 5/473

[58] Field of Search ..... 5/90, 449, 450, 453, 5/454, 459, 462, 463, 468, 469, 473, 481; 297/180, DIG. 3

[56] References Cited

U.S. PATENT DOCUMENTS

| | | | |
|---|---|---|---|
| 2,686,006 | 8/1954 | Hasselquist | 5/454 |
| 2,997,100 | 8/1961 | Morris | 5/450 |
| 3,017,642 | 1/1962 | Rosenberg et al. | 5/450 |
| 3,058,124 | 10/1962 | Sturtevant | 5/468 |
| 3,154,798 | 11/1964 | Harris et al. | 5/468 |
| 4,276,666 | 7/1981 | Yamada | 5/481 |
| 4,573,740 | 3/1986 | Frobose | 5/468 |
| 4,620,333 | 11/1986 | Ritter | 5/463 |
| 4,620,337 | 11/1986 | Williams et al. | 5/468 |

*Primary Examiner*—Gary L. Smith
*Assistant Examiner*—Michael F. Trettel
*Attorney, Agent, or Firm*—James J. Ralabate

[57] ABSTRACT

A sterile mattress unit that contains a mattress, an air tight cover of micro filter material enclosing the mattress and a gas reservoir that supplies gas to the interior of the cover is disclosed. The reservoir is a flexible structure that expands and contracts as weight is placed upon or taken from the surface of the mattress. A medicated agent is preferably included in the gas and gas reservoir to provide protection against microorganisms.

12 Claims, 3 Drawing Figures

STERILE MATTRESS UNIT

This application is a Continuation in Part application Ser. No. 06/735,846 filed in the United States Patent and Trademark Office on May 21, 1985.

This invention relates to a distensible mattress unit and, more particularly, to a controllable substantially sterile mattress system.

BACKGROUND OF THE INVENTION

It is known to use various means to minimize staff infections of patients who are bedridden with various medical ailments. It is not unusual for patients to develop infections of various types and even decubitus ulcers when confined to a bed for any extended period of time.

In U.S. Pat. 3,308,488 a bacteriostatic drawsheet is suggested to decrease the possibility of serious infections in recumbent patients. This patent and others teach treating a drawsheet with various bacteriostatic agents such as oxyquinoline to inhibit the growth of bacteria and other organisms. The use of treated rubber sheeting to be brought into direct contact with the patient's skin presents an impractical and uncomfortable solution to this problem. In addition, wear and cracking of the rubber sheet eventually dilutes the effectiveness of the bacteriostatic agents and eventually renders the sheet relatively ineffective. This U.S. patent suggests an improved drawsheet formed from polyolefin and having a textured surface which could improve the effectiveness of the bacteriostatic agent and improving the flexibility of the drawsheet. In addition, the drawsheet of this patent is considered to retard the growth of bacteria and maintains the bacterial concentration at low levels. Since these drawsheets are limited in duration and are disposable, they can become relatively expensive to use. In addition, the practice in hospitals is to change the overlying cotton sheets frequently. This could present a danger not only to the patient but also to the hospital personnel handling the contaminated sheets and drawsheets. Thus, the expedient of using a bed or mattress covering composed of a plastic sheeting having a bacteriostatic agent has some serious limitations.

In U.S. Pats. Nos. 2,886,834; 3,792,501; 4,149,285; and 4,485,505 various devices are disclosed relating to air-cushioned furniture. In 2,886,834 to Gilbertson, a self-inflating mattress is disclosed having stiffening means for urging the mattress into an expanded condition. This mattress contains an inflatable chamber forming a part of the mattress which is capable of functioning as a pump by being intermittently compressed for inflating the remainder of the mattress.

In U.S. Pat. No. 3,792,501 furniture is disclosed that uses air for buoyancy and support and in Stanton U.S. Pat. No. 4,149,285 an air support mattress is described. In Stanton, the mattress disclosed has perforations in patterns to provide air stream flow. A compressed air pump is used in Stanton to supply the air to his air mattress. The air pad or mattress of Stanton is designed for use with a conventional bed and intended primarily to increase the comfort of a bedridden patient.

The Paul Pat. No. 4,485,505 discloses a mattress with an inflatable base having resilient support cells on its upper surface. A cover is positioned over the cells with a gas inlet to provide increased pressure between the cover and the cells. The cover is perforated to allow ventilation of a bedridden patient. The Paul apparatus is primarily designed to provide improved comfort and to diminish the possibility of formation of decubitus ulcers.

None of the above references discloses a mattress unit hermetically sealed by an enclosure that will allow a treated atmosphere to be contained therein and will block the entrance therein of microorganisisms such as bacteria or virus.

SUMMARY OF THE INVENTION

It is therefore an object of this invention to provide a mattress unit that is devoid of the above-noted disadvantages.

Another object of this invention is to provide a substantially sterile mattress that is resistant to microorganisms and precludes either their entrance or exit from the mattress.

A still further object of this invention is to provide a substantially sterile mattress unit that maintains its sterility over an extended period of time because of its composition.

Another still further object is to provide a sterile mattress unit that is relatively comfortable and yet retards the formation of decubitus ulcers and the like.

These and other objects are accomplished by the present invention generally speaking by providing a mattress unit comprising a micro-tight cover enclosing a mattress. An atmosphere or gas-containing silicone balloon or balloons provide for a treated gas to fill the internal portion of said cover when desired. The mattress is covered with a completely sealed material preferably made of medical grade silicone that is microfilter material that will allow ambient atmosphere, other gases, vapors, etc. to pass but will block totally and completely any and all micro structures such as bacteria or virus of whatever micro size. It is not necessary to make the mattress totally sterile on the inside since the silicone cover will not permit micro structures to pass in either direction. If the interior of the mattress is silicone foam, microorganisms trapped inside the mattress or balloon would die because silicone has no food value. Any air forced from the mattress because of compression from the weight of the patient will be forced into a silicone elastomeric container or other suitable reservoir which will accept the air while enclosed in a protective box. Upon the patient rising from the bed, the sterile air will be returned to the mattress as it expands. Important to this invention is the micro filter cover on the mattress that totally prevents all micro structures of whatever size from entering or exiting the mattress. The cover preferably will be constructed of silicone materials unless Gortex is used. However, expanded Teflon Gortex such as that used in astronauts' space suits is almost prohibitively expensive. Any other material having at least as good properties as the silicone may be used if suitable. The entire mattress is enclosed and covered with an airtight, extremely tough, strong, high tear strength, long-chained, cross-linked (highly cross-linked) silicone material designed for medical applications. It offers no food value at all for bacteria or other structures. It also will withstand intense heat. A lighted cigarette allowed to burn on the mattress surface will burn itself out causing a slight swelling on the surface material which will cool immediately and return to its original condition leaving no marring or evidence of any kind that heat had been applied to the surface.

It is not important that functional agents be used and introduced into the interior portion of the cover in a sterile manner since microorganisms can neither enter nor exit through the micro screen silicone cover. Medication agents can be introduced into the system at any convenient location, i.e. cover-balloon-conduit. It is important, however, that after introduction of these agents that the system be restored to its hermetically sealed condition. The environment provided by the mattress unit of this invention may be used with a variety of mattresses. While it is preferred to use this system with the bed structure disclosed in co-pending U.S. patent application Ser. No. 06/735,846 now Pat. No. 4,620,333 filed May 21, 1985, it may also be used with any suitable bed or mattress system. To enhance the effectiveness of the mattress unit of this invention, the body of the mattress can be made from multi-tiered levels of convoluted polyurethanes or silicone. These multi layers add many more additions of empty pockets within the supporting structure which reduce greatly the resistance of the mattress to bone protuberances and areas of the body that have a thin skin covering or have poor circulation. It is because of the empty pockets created by multiple layers of convolution, that the mattress becomes extremely soft and offers very little abrasion to the skin. The preferred silicone materials used are Dow Corning Medical Grade and General Electric's Two Part Flexible Foam System; the preferred polyurethane materials are fire retardant polyurethane that meets California's fire code #117, obtained from Clark Brothers in Chicago, Ill. The airtight silicone cover that encloses the mattress is preferably constructed from silicone materials identified as Q7-4750 medical grade obtained from Dow Corning in Michigan. Other materials for the cover are generally other forms of suitable silicones with properties similar to Q7-4750. The preferred antibacterial agent or disinfectant to be used to cleanse or disinfect the outer surfaces of the mattress is (IPA) isopropyl alcohol and/or distilled water and mild non-oil-based soap. Products containing sulfur or peroxide physically degrade what is basically an extremely strong silicone product and thus should be avoided unless they can be made suitable for this use. The greater their concentration, the greater the damage to the silicone.

Silicone mattresses are autoclavable wet or dry, but preferably in a dry condition. They may also be irradiated but the manufacturers of silicone do not know to what degree silicone will react over a long period time and many irradiation treatments.

If desirable, a totally sealable tent attached to the mattress may be used together with the sealed mattress unit of this invention. Thus, enclosure of a mattress in an airtight, sealed, sterile silicone cover together with a sealable tent also with a sterile atmosphere would provide optimum protection for a patient requiring this treatment. Since the silicone cover on the IBF mattress is hydrophobic when treated with spray silicone or the proper medications, it is the ideal surface to place burn victims on. The silicone usually will not adhere to the scabbing and may even hasten scabbing and cure through the introduction of molecular medication in a vapor form. It is estimated that 90% of burn victim deaths are due to secondary infections. The sterile environment of the mattress unit of this invention that micro filters all gases that pass through or into the mattress may, in conjunction with a totally secured Gortex or silicone tent, enable the burn victim's body to be treated in total in a totally sterile environment. The pores or micro pores in the silicone cover permit medication contained within the cover to reach the patient and at the same time prevent the migration of bacteria or other microorganisms therein.

DESCRIPTION OF THE DRAWING AND PREFERRED EMBODIMENTS

Figure 1:
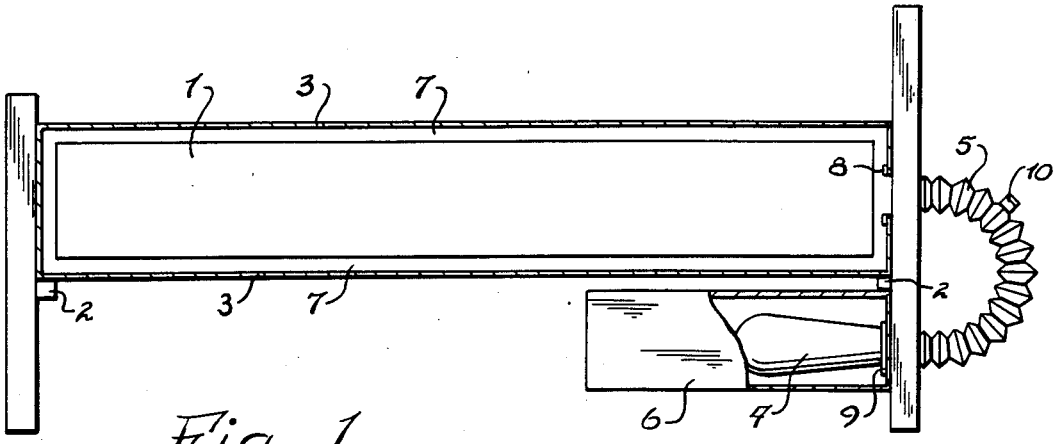
FIG. 1 is a perspective view of a conventional bed with the cover of the present invention.

A conventional mattress 1 used with conventional metal or other supports 2 is enclosed in a hermetically-sealed cover 3. The cover 3 is preferably made from a medical grade flexible silicone that is of a micro filter material that will allow ambient atmosphere, other gases, vapors and the like to pass but will block totally all microorganisms such as bacteria or virus of micro size. The mattress 1 will therefore be completely surrounded by a sterile atmosphere or air cushion of liquid or gas 7. While it is preferred to use a gas with an antibacterial agent or other medicinal agent therein, it is also possible to use a liquid with those same agents dispersed therein. Thus, while a gas will be referred to throughout this disclosure, it is conceivable that a suitable liquid may be used. A source or reservoir of gas such as a silicone balloon 4 or silicone balloons contain a gas having an antibacteria and antiviral agent dispersed therein. Any other suitable agent may also be used in the gas of silicone balloon 4. In place of silicone balloon 4 any other suitable gas reservoir may be used as long as it permits gas to flow to and from said reservoir and the internal portion of cover 3. Thus, while balloons will be described and illustrated throughout this disclosure, any suitable gas container or reservoir may be used. The gas from silicone balloon 4 passes through flexible tube or conduit 5 into and around mattress 1. Any gas or air forced from around mattress 1 because of compression from the weight of the patient will be forced into the silicone elastomeric balloon or container 4 which will accept the sterile gas while enclosed in a protective box or housing 6. Upon the patient rising from the bed or mattress 1, the sterile gas will be returned to the mattress 1 as it expands. While the medical grade silicone that is used for cover 3 is a micro filter material that will allow gases to permeate it, at the same time it will prevent microorganisms such as bacteria or viruses from permeating it. The mattress 1 is preferred to be constructed from multi-tiered levels of convoluted, foamed polyurethane or silicone. These multi-layers add many more additions of empty pockets within the supporting structure which will reduce greatly the resistance of the mattress 1 to human bone protuberances and also areas of the body that have a thin skin covering or areas of the body with poor blood circulation. Because of these empty pockets created by multiple layers of convolution, the mattress becomes extremely soft and permits very little abrasion to the skin. The use of convoluted silicone layers made from silicone foam available from General Electric is preferred since it has virtually no compression set. That is, it will return easily to its original expanded state after depressed or compacted. In some cases, it may be advisable to use solid unconvoluted soft silicone foam of varying densities. Also, using the above-described silicone for the material of the mattress 1 and cover 3, it has the bonus effect of imparting fire resistance to the unit. Also, since the silicone used in cover 3 is hydrophobic it is especially useful for patients who have burns or abrasions or decubitus ulcers particularly when the surface is sprayed with liquid silicone or when medication is applied to the surface of the mattress. The silicone will not easily adhere to these wounds and may in some instances abet in the curing process through the introduction of the medication which permeates the cover 3 from the interior of cover 3. A hydrophobic pillow containing nearly 2900 five-sixteenths inch wide hydrophobic drain holes not shown in the drawing may be also enclosed with the same cover 3 to make the entire bed unit more sterile. In this event, the blocks 20 are replaced by the pillow and the pillow is supported by a fiberglass grid containing over 2900 three-eighths holes which in turn is supported by a multitude of fiberglass feet sitting in, but removable, from the toilet tray 11. The top of the grid sits about three-eighths of an inch off the bottom of the tray which has a slight crown in the middle. While housing 6 is shown at the head portion of the bed, it may be positioned at the foot portion of the bed or both the head and foot portions of the bed. It is preferred that housing 6 be constructed of fiberglass such as FDA approved products available from Molded Fiberglass Company, East Erie Street, Linesville, Pa. The balloons used should preferably be medical grade silicone balloons of the type made from Q7-4750 silicone available from Dow Corning Company in Michigan. The accordian-like flexible tubing 5 is also preferred to be a silicone cover tubing that has airtight connections 8 for the cover 3 connection and connections 9 for the housing 5 connection. These connections may be any convenient means as long as the terminal portions of tubing 5 are airtight. A clamp around each could be used to ensure the integrity of the air seal therein.

Figure 2:
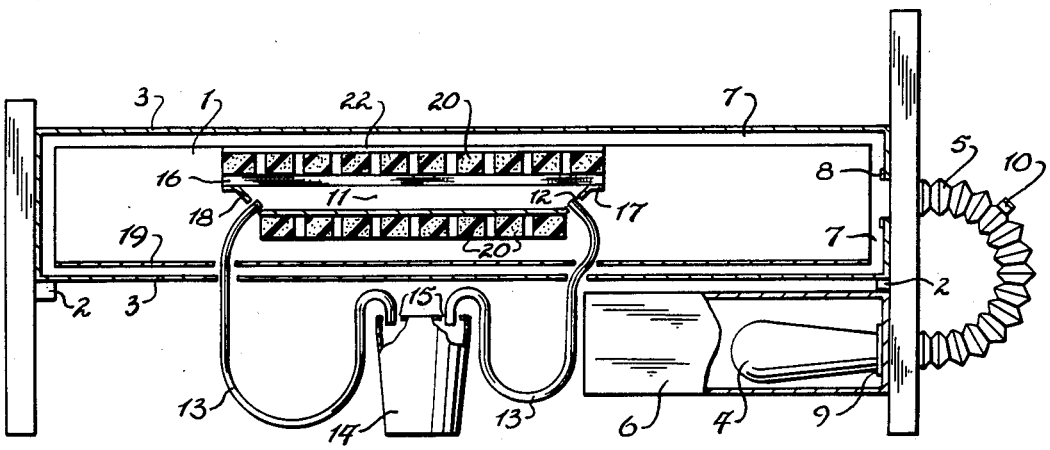
FIG. 2 is a perspective view of an IBF bed with the cover of the present invention.

In FIG. 2 an incontinent bed facility such as described in co-pending parent application Ser. No. 06/735,846 now U.S. Pat. No. 4,620,333 is illustrated. The description and disclosure Ser. No. 06/735,846 now Pat. No. 4,620,333 is incorporated into this disclosure by reference hereby. The term "incontinent bed facility" or I.B.F. when used in this disclosure and in the claims, will refer to a bed similar to that disclosed in parent application Ser. No. 06/735,84 now Pat. No. 4,620,333. In FIG. 2, the unit is shown having a collecting pan or vessel 11 which can be positioned in a bed or chair at a plane approximately parallel with the plane of the floor and mattress 1. This pan or toilet tray 11 is constructed of a non-rustable material such as fiberglass. Located at each corner of tray 11 are openings 12 into which rubber or plastic tubing 13 may be fitted. It is preferred that PVC fittings be located in each corner to facilitate substantially leakproof connection to tubing 13. However, any suitable means may be used provided each corner is accommodated with proper draining means. Tubing 13 extends from each corner opening 12 into a collection vessel 14 by gravity flow from which the urine is disposed of. Tray 11 is a conventional 26-inch square fiberglass tray one and one-eighth inches deep readily available on the market. Tubing 13 is preferably silicone tubing to prevent the movement of bacteria, viruses, etc. through the tubing walls or nylon reinforced vinyl tubing or one-half inch ID PVC tubing available also on the market. Collection vessels 14 are commercially available fiberglass or plastic containers having appropriate openings 15 at the top portion to receive tubing 13. The fiberglass toilet tray 11 has a one-eighth inch thick fiberglass sheet cut to exactly fit the tray size and perforated with about 2900 three-eighth inch holes on half-inch centers and set upon a multitude of feet about three-eighths of an inch from the bottom of the tray (with a slight center crown) to the top of the grid. The grid supports either the pillow of many holes with skinned leaktight hydrophobic silicone or it supports the blocks which are also silicone skinned in a leaktight manner. The sidewalls 18 taper inwardly from the edge of the lip 17. The drain fittings 12 are situated in each of the four corners of tray 11 and are placed as indicated above through the container 11 and connected in a liquid-tight manner to tubing 13. A silicone well 19 is positioned completely around the bottom portion of the unit having apertures through which tubing 13 is sealed liquid-tight and stainless steel clamped and passes and extends into collection containers 14. Liquid-tight sealed convoluted or closed cell foam blocks 20 are placed on the nylon netting or fiberglass grid 16 which is on the toilet tray 1. The blocks 20 are situated and sometimes attached together in such a manner that there is substantial space in between them so that liquids will readily flow therebetween. Above blocks 20 is a sealed cell foam sheet or liquid-tight pillow with a multitude of drain holes which increases the resiliency of the entire unit. The liquid will pass through the closed cell sheet of many holes or liquid-tight pillow with many holes, in between the liquid-tight blocks, the nylon net cover or fiberglass grid 16 and by gravity into the tray 11 and out one of the openings in the four corner drains 12 which are set in the tray such that the bottom of each drain interior is slightly below the bottom of the toilet tray 11. Convoluted foam blocks 20 are preferably made of liquid-tight enclosed polyurethane or sealed cell blocks or liquid-tight skinned silicone blocks having a proper density. A sealed cell foam sheet 22 containing a plurality of drain holes is placed on top of the liquid sealed polyurethane or sealed silicone block 20 to provide a soft, comfortable surface on which the patient will lie. This sheet 22 is made from a sealed cell foam or preferably a skinned liquid-tight silicone foam available from General Electric or Dow Corning. Other sealed closed cell foams may be used provided that they have no detrimental effect when in contact with the skin. Typical sealed cell foams are "ENSOLITE" from Uniroyal Company, "ARMAFLEX" made by Armstrong Cork Company and "NEOPRENE" available from American Rubber Products Corporation of North Tonawanda, NY. Since the tray 11 drains in at least four openings 12, the patient can rest in any position even though the attitude of the tray changes its relative angle and position as the patient shifts his or her weight. The urine flow in the toilet tray 11 can pass in any direction and will be drained since the center of the tray is very slightly raised such that liquids will be inclined to drain through the openings or drains 12. Drainage is accomplished by gravity flow without any need for expensive pumps or other equipment. The unit of this invention contains component parts of convoluted foam which eliminates pressure on the skin from bone protuberances thus minimizing the potential for the formation of decubitus ulcers. The unit also maintains the patient as dry as possible while providing a sanitary, comfortable reclining surface. Elements 1–9 as shown in FIG. 2 have the same function as elements 1–9 described in reference to FIG. 1 above.

Figure 3:
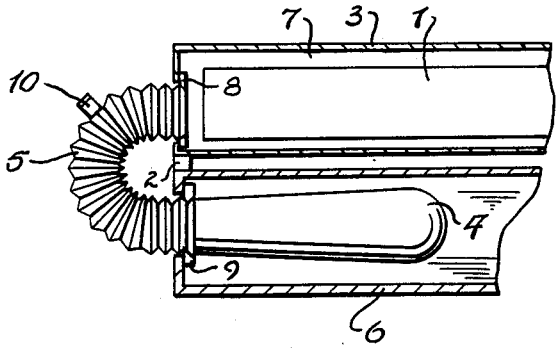
FIG. 3 is a cutaway view of the connection between the reservoir and mattress cover of this invention.

In FIG. 3 a sectional view of the housing 6 and cover 3 is illustrated. This close-up view is taken from both FIGS. 1 and 2 and elements 1–9 are the same as like elements of FIGS. 1 and 2 with the same function. Sterile atmosphere or space 7 will, of course, depend upon the internal pressure of the gas and the flexibility of cover 3. Conduit 5 must have completely airtight seals 8 and 9 at its terminal portions to ensure that the internal atmosphere within cover 3 remains sterile and medicated. The internal pressure can be easily controlled by the size of balloon 4 used and the amount of gas introduced into the system. A sterile gas and medication or sterilization agents can be introduced into the system by any convenient means such as by feed inlet 10 located on conduit 5. It can be of any suitable construction but must be supplied with an airtight seal for sealing after introduction of the medication and/or gas into the system. When desirable, the accordian type flexible silicone tubing 5 will connect a pillow (not shown in drawing) and the wall of the mattress cover 3 in an air tight manner such that the pillow will share the medicated (or sterile) atmosphere provided by the gas in reservoir 4. While this disclosure illustrates the invention with reference to a bed and mattress unit, the concept can be equally applicable and useful with chairs or other pieces of furniture where a sterile system is desirable. The drain openings 12 are preferably at right angles or perpendicular to the horizontal axis of tray 11 for better drainage. The drawings however show openings 12 along the side of tray 11 for clarity in this disclosure. Tubing 13 is also preferably spiral (similar to phone cord) to prevent easy pulling outside the lower area of the bed when it is desired to empty container 14.

The preferred and optimumly preferred embodiments of the present invention have been described herein and shown in the accompanying drawing to illustrate the underlying principles of the invention but it is to be understood that numerous modifications and ramifications may be made without departing from the spirit and scope of this invention.

What is claimed is:

1. A substantially sterile mattress unit comprising a mattress, a micro-filter tight mattress cover enclosing said mattress and means to control the internal atmosphere of said cover, said means comprising at least one flexible reservoir for housing a gas, and an airtight conduit connecting said reservoir to the internal portion of said cover, said reservoir adapted to permit the free flow of said gas between itself and the internal portion of said cover, said gas permitted to flow through said conduit to and from said reservoir and said internal portion of said cover.

2. The unit of claim 1 wherein a sterilizing agent is added to said gas in said unit.

3. The unit of claim 1 wherein it is used in combination with an incontinent bed facility.

4. A substantially sterile mattress unit comprising a mattress, a micro-filter tight cover enclosing said mattress, and means to control the internal atmosphere of said cover, said means comprising at least one substantially large deflatable balloon and an airtight conduit connecting said balloon to the internal portion of said cover, said balloon adapted to expand with gas when pressure is exerted upon said airtight cover, and deflate upon the absence of pressure upon said cover, when said balloon is in its deflated stage, the gas being transferred to the internal portion of said cover.

5. The mattress unit of claim 4 wherein said gas contains a disinfectant that renders said gas substantially sterile.

6. The mattress unit of claim 4 wherein said conduit contains a feeding means through which disinfectant or sterilizing agent can be fed, said feeding means having an airtight sealing means used after said feeding.

7. A substantially sterile mattress unit comprising a mattress, a micro-filter light silicone cover enclosing said mattress and means to control the internal atmosphere of said cover, said means comprising at least one substantially flexible reservoir for housing a gas, and an airtight conduit system connecting said flexible reservoir to the internal portion of said cover, said reservoir adapted to permit the free flow of said gas between itself and the internal portion of said cover, said gas permitted to flow through said conduit to and from said reservoir and said internal portion of said cover, said mattress comprising multi-tiered levels of a material, said flexible reservoir adapted to permit the free flow of said gas between itself and the internal portion of said cover, said gas permitted to flow through said conduit to and from said reservoir and said internal portion of said cover.

8. The unit of claim 7 having sealable means for introducing a medication agent into said system.

9. The unit of claim 7 wherein it is used in combination with an incontinent bed facility.

10. The mattress unit of claim 7 wherein said conduit contains a feeding means through which a disinfectant or sterilizing agent can be fed, said feeding means having an airtight sealing means used after said feeding.

11. The mattress unit of claim 7 wherein said convoluted material is a composition selected from the group consisting of silicone, polyurethanes and mixtures thereof.

12. The mattress unit of claim 7 wherein said micro-filter light cover is made from a micro filter silicone material adapted to prevent the passage therethrough of any microorganism.

* * * * *